US008761649B2

(12) United States Patent
Tanda

(10) Patent No.: US 8,761,649 B2
(45) Date of Patent: Jun. 24, 2014

(54) FIXING DEVICE WITH DRIVE UNIT FOR CORE UNIT, IMAGE FORMING APPARATUS AND ELECTROMAGNETIC-INDUCTION HEATING UNIT

(75) Inventor: Tetsuo Tanda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 392 days.

(21) Appl. No.: 13/073,078

(22) Filed: Mar. 28, 2011

(65) Prior Publication Data

US 2011/0236091 A1 Sep. 29, 2011

(30) Foreign Application Priority Data

Mar. 29, 2010 (JP) ..... 2010-074435
Nov. 29, 2010 (JP) ..... 2010-264947

(51) Int. Cl.
*G03G 15/20* (2006.01)

(52) U.S. Cl.
USPC ..... 399/329

(58) Field of Classification Search
USPC ..... 399/328, 329
See application file for complete search history.

(56) References Cited

U.S. PATENT DOCUMENTS 5,200,785 A * 4/1993 Hoover et al. ..... 399/122
2004/0101334 A1* 5/2004 Tatematsu et al. ..... 399/329
2007/0014599 A1 1/2007 Yasuda et al.
2009/0175644 A1* 7/2009 Nanjo et al. ..... 399/69
2009/0245898 A1* 10/2009 Gon et al. ..... 399/328
2009/0245902 A1* 10/2009 Gon et al. ..... 399/331
2010/0014900 A1* 1/2010 Gon ..... 399/330
2010/0046996 A1* 2/2010 Nanjo et al. ..... 399/330

FOREIGN PATENT DOCUMENTS

JP 2002-082549 A 3/2002
JP 2007-183473 A 7/2007
JP 2009-037264 2/2009
JP 2009-237402 A 10/2009

* cited by examiner

*Primary Examiner* — Quana M Grainger
(74) *Attorney, Agent, or Firm* — Frommer Lawrence & Haug LLP

(57) ABSTRACT

A fixing device for fixing a toner image on a recording medium includes a toner fusing unit that is operable to fix the toner image on the recording medium and that includes a pressure member and a heating member in contact with the pressure member to form a fixing nip therebetween; an electromagnetic-induction heating unit having a coil disposed along an outer surface of the heating member and configured to generate a magnetic flux for applying induction heating to the heating member, and a core unit disposed opposite the heating member with the coil interposed therebetween to provide for a magnetic path around the coil, the core unit being configured to rotate about an axis extending across the width of the recording medium; and a drive unit formed integrally with the electromagnetic-induction heating unit and configured to rotate the core unit.

15 Claims, 10 Drawing Sheets

FIXING DEVICE WITH DRIVE UNIT FOR CORE UNIT, IMAGE FORMING APPARATUS AND ELECTROMAGNETIC-INDUCTION HEATING UNIT

INCORPORATION BY REFERENCE

This application is based upon and claims the benefit of priority from the corresponding Japanese Patent application No. 2010-074435, filed Mar. 29, 2010, and Japanese Patent application No. 2010-264947, filed Nov. 29, 2010, the entire contents of which are incorporated herein by reference.

TECHNICAL FIELD

The present disclosure relates to a fixing device that fixes an unfixed toner image on a recording medium bearing the toner image by heating and fusing the toner image while the recording medium is passed through a nip between fixing rollers or between a heating belt and a roller. The present disclosure also relates to an image forming apparatus including the fixing device.

BACKGROUND

In recent years, due to demand for energy savings and shorter warm-up time (i.e., the amount of time between when the image forming apparatus is turned on and when the fixing device is ready for the fixing operation) in a fixing device, a belt-type fixing method used in image forming apparatuses has attracted attention in which heat capacities can be set to small values. Also in recent years, as a heating method used in fixing devices, an electromagnetic induction heating method (IH) which can provide quick and high-efficiency heating has attracted attention. For saving energy in fixing color images, many products that combine the belt-type fixing method with the electromagnetic induction heating method have been commercially available. When the belt-type fixing method and the electromagnetic induction heating method are combined, a device (coil) that generates a magnetic flux for electromagnetic, induction is often provided outside a fixing belt (so-called external IH). Using this arrangement is advantageous in that a coil that generates a magnetic flux for electromagnetic induction can be easily laid out and cooled, and that the belt can be directly heated.

In the electromagnetic induction heating method described above, various techniques have been developed to prevent a heated member, such as a fixing belt, from overheating in a non-sheet-passing region, in accordance with the width of a sheet that passes through the fixing device (sheet passing width). In particular, a size switching technique in external IH is known. In this technique, a ferrite center core that forms a magnetic path around a coil is provided, and the center core is configured to be rotated by power from a drive unit. Thus, a selection can be made as to whether induction heating is to be applied to the heated member by a magnetic flux generated by the coil, or induction heating is to be suppressed by blocking or suppressing the magnetic flux. With this technique, the amount of heat generation in the non-sheet-passing region of the heated member can be set to a value different from that in the sheet passing region.

If the fixing device described above has a configuration in which a unit on the side of the coil and the center core (hereinafter referred to as an electromagnetic-induction heating unit) and a unit on the side of the heated member (hereinafter referred to as a toner fusing unit) are combined as an integral unit, the entire fixing device needs to be replaced in the event of a problem that requires replacement of only one component of the fixing device. Since even components that do not need to be replaced become subject to replacement, there is a concern that costs involved in replacement cannot be reduced.

Such a concern can be resolved if the electromagnetic-induction heating unit and the toner fusing unit are configured separately. For example, it is possible that the electromagnetic-induction heating unit is disposed such that it cannot be removed from the image forming apparatus main body, whereas the toner fusing unit is configured such that it can be attached to and removed from the electromagnetic-induction heating unit.

However, if the electromagnetic-induction heating unit and the toner fusing unit are configured to be separated from each other, the drive unit and the electromagnetic-induction heating unit of the fixing device may be easily damaged when the toner fusing unit is attached to the electromagnetic-induction heating unit.

Specifically, to make the axis of the center core parallel to that of the heat roller at the point when the toner fusing unit is attached to the electromagnetic-induction heating unit, it is necessary that the electromagnetic-induction heating unit be mounted on the image forming apparatus main body with some degree of freedom (i.e., such that the electromagnetic-induction heating unit is movable relative to the image forming apparatus main body) until the toner fusing unit is attached. In this case, if the drive unit is disposed in the image forming apparatus main body, there is a possibility that a connecting component of the drive unit may hit that of the toner fusing unit when the toner fusing unit is attached to the electromagnetic-induction heating unit. More specifically, since a speed reduction gear train of the drive unit and a driven gear of the toner fusing unit are brought into contact with each other in an unstable state, a problem such as improper gear engagement, possibly resulting in damage and/or loss of a gear tooth, may occur when the toner fusing unit is mounted. It may be possible to provide a positioning mechanism for positioning the speed reduction gear train and the driven gear. However, since this adds complexity to the existing mechanism, it is difficult to reduce the manufacturing cost and the size of the apparatus.

In solving such a problem, it is to be noted, that the drive unit typically may be disposed at a corner of the image forming apparatus main body, and that in such a case the drive unit cannot easily come into contact with a flow of air for cooling the interior of the image forming apparatus main body. This lack of cooling may have deleterious effects on performance or reliability because if components of the drive unit are heated to temperatures that exceed the upper temperature limits that the components can bear, these components cannot fully demonstrate their performance.

SUMMARY

Accordingly, the present disclosure is related to a fixing device in which an electromagnetic-induction heating unit that can be separated from a toner fusing unit has improved reliability, and to an image forming apparatus including the fixing device.

A fixing, device according to an aspect of some embodiments of the present disclosure is a fixing device for fixing a toner image on a recording medium. The fixing device includes a toner fusing unit that is operable to fix the toner image on the recording medium and that includes a pressure member and a heating member in contact with the pressure member to form a nip therebetween; an electromagnetic-induction heating unit having a coil disposed along an outer surface of the heating member and configured to generate a magnetic flux for applying induction heating to the heating member, and a core unit disposed opposite the heating member with the coil interposed therebetween to provide for a magnetic path around the coil, the core unit being configured to rotate about an axis extending across the width of the recording medium; and a drive unit formed integrally with the electromagnetic-induction heating unit and configured to rotate the core unit.

In accordance with some embodiments, an image forming apparatus includes an image forming section configured to form a toner image, a transfer section configured to transfer the toner image formed by the image forming section to a recording medium, and a fixing device configured to fix the toner image transferred by the transfer section to the recording medium on the recording medium. The fixing device includes a toner fusing unit that is operable to fix the toner image on the recording medium and that includes a pressure member and a heating member in contact with the pressure member to form a nip therebetween; an electromagnetic-induction heating unit having a coil disposed along an outer surface of the heating member and configured to generate a magnetic flux for applying induction heating to the heating member, and a core unit disposed opposite the heating member with the coil interposed therebetween to provide for a magnetic path around the coil, the core unit being configured to rotate about an axis extending across the width of the recording medium; and a drive unit formed integrally with the electromagnetic-induction heating unit and configured to rotate the core unit.

Some embodiments provide an electromagnetic-induction heating unit for use in a fixing device for fixing a toner image on a recording medium. The electromagnetic induction heating unit includes a coil configured to generate a magnetic flux for applying induction heating, a core unit, and a drive unit. The core unit is disposed to provide for a portion of a magnetic path around the coil, and is configured to rotate about an axis extending along the width of the recording medium when the electromagnetic-induction heating unit is installed for use. The drive unit is formed integrally as part of the electromagnetic-induction heating unit and is configured to rotate the core unit.

It is understood that the foregoing summary is representative of some embodiments of the disclosure, and is neither representative nor inclusive of all subject matter and embodiments within the scope of the present disclosure.

The above and other objects, features, and advantages of various embodiments of the present disclosure will be more apparent from the following detailed description of embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include".

Various features of novelty which characterize various aspects of the disclosure are pointed out in particularity in the claims annexed to and forming a part of this disclosure. For a better understanding of the disclosure, operating advantages and specific objects that may be attained by some of its uses, reference is made to the accompanying descriptive matter in which exemplary embodiments of the disclosure are illustrated in the accompanying drawings in which corresponding components are identified by the same reference numerals.

BRIEF DESCRIPTION OF THE DRAWINGS

The following detailed description, given by way of example, but not intended to limit the disclosure solely to the specific embodiments described, may best be understood in conjunction with the accompanying drawings, in which.

DETAILED DESCRIPTION OF EMBODIMENTS

Reference will now be made in detail to various embodiments of the disclosure, one or more examples of which are illustrated in the accompanying drawings. Each example is provided by way of explanation of the disclosure, and by no way limiting the present disclosure. In fact, it will be apparent to those skilled in the art that various modifications, combinations, additions, deletions and variations can be made, without departing from the scope or spirit of the present disclosure. For instance, features illustrated or described as part of one embodiment can be used in another embodiment to yield a still further embodiment. It is intended that the present disclosure covers such modifications, combinations, additions, deletions, applications and variations that come within the scope of the appended claims and their equivalents.

Figure 1:
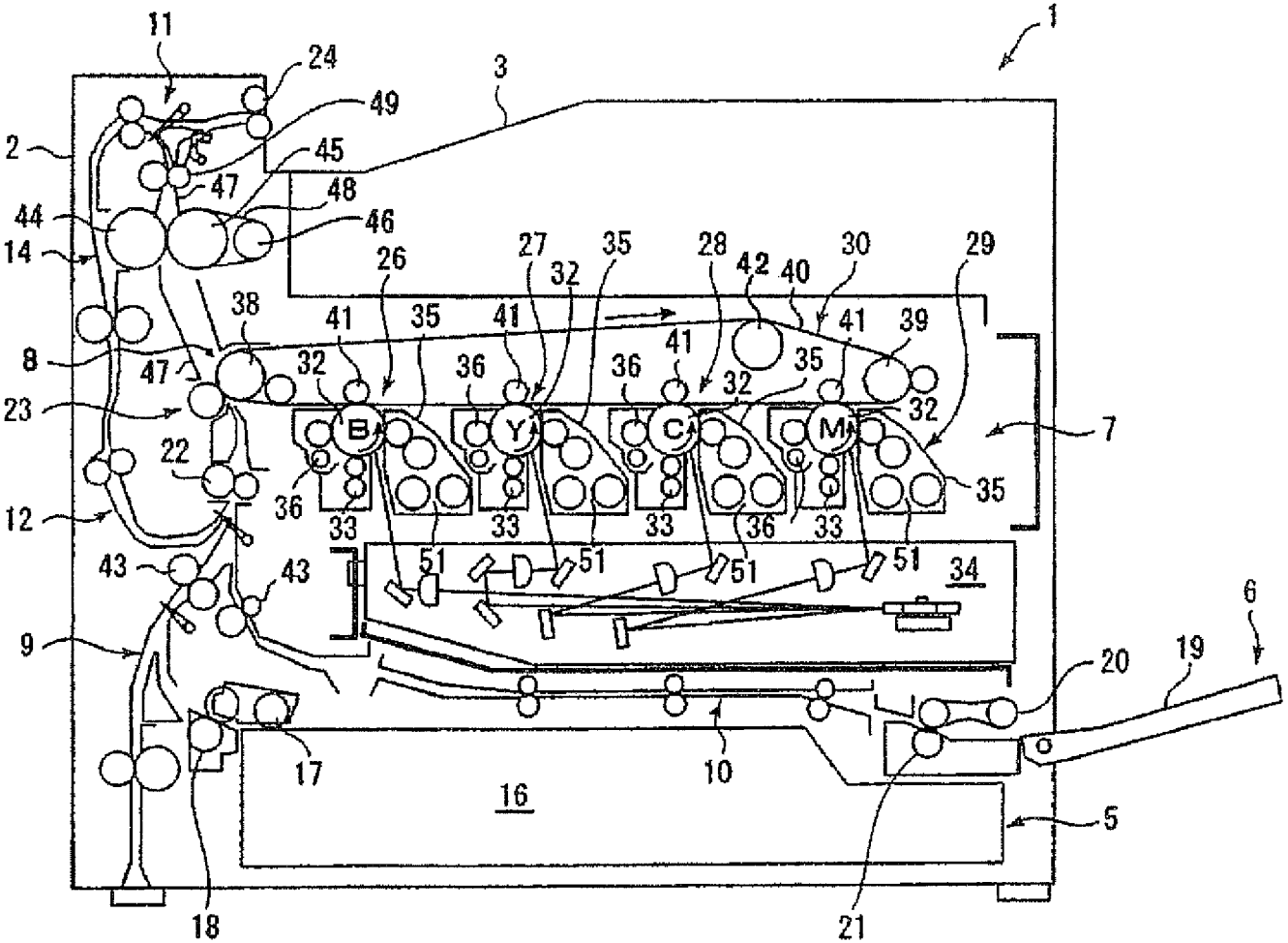
FIG. 1 is a schematic diagram illustrating a configuration of an image forming apparatus according to an embodiment.

FIG. 1 is a schematic diagram illustrating a configuration of an image forming apparatus 1 according to an, embodiment. The image forming apparatus 1 is capable of performing a printing, operation in which a toner image is transferred to a surface of a recording medium (e.g., a sheet of paper P) on the basis of image information externally input. Examples of the image forming apparatus 1 include a printer, a copier, a facsimile, and a multi-functional peripheral that combines these functions. In the following embodiments, the present disclosure can be implemented even when the recording medium is not a sheet of paper P, but is another type of recording media such as an overhead projector (OHP) sheet or the like.

The image forming apparatus 1 illustrated in FIG. 1 is, for example, a tandem color printer. The image forming apparatus 1 includes a rectangular box-shaped apparatus main body 2 in which color images are formed (printed) on sheets P. The top surface of the apparatus main body 2 is provided with a discharge tray 3 onto which sheets P with color images printed thereon are discharged.

A paper feed cassette 5 for accommodating sheets P is disposed internally in a bottom part of the apparatus main body 2. A stacking tray 6 for feeding types of sheets P that are not accommodated in the paper feed cassette 5 to the apparatus main body 2 is disposed on the right lateral side of the apparatus main body 2. An image forming section 7 is disposed in the upper part of the apparatus main body 2. The image forming section 7 forms the toner images on sheets P on the basis of image information (e.g., including text and graphic data) transmitted from a higher-level device or host apparatus, such as a personal computer (PC), connected to the image forming apparatus 1.

In the left part of the apparatus main body 2 in FIG. 1, there is a first conveying path 9 for conveying a sheet P fed out of the paper feed cassette 5 to a secondary transfer unit 23 (described below). Also, there is a second conveying path 10 that extends from right to left in the apparatus main body 2. The second conveying path 10 is for conveying a sheet P fed out of the stacking tray 6 to the secondary transfer unit 23. A fixing unit (fixing device) 14 and a third conveying path 11 are disposed internally in the upper left part of the apparatus main body 2. The fixing unit 14 performs a fixing process on a sheet P onto which a toner image has been transferred by the secondary transfer unit 23. A sheet P having been subjected to the fixing process is conveyed along the third conveying path 11 to the discharge tray 3.

The left lateral side of the apparatus main body 2 in FIG. 1 is configured, for example, such that it can pivot about lower hinges or can be horizontally pulled out leftward. When the left lateral side is opened relative to the apparatus main body 2, a fourth conveying path 12 and a unit mounting part 93 (described below with reference to FIG. 9 and FIG. 10) for mounting the fixing unit 14 can be opened and accessed externally.

When the paper feed cassette 5 is pulled out from the apparatus main body 2 (e.g., frontward in FIG. 1), sheets P can be loaded in the paper feed cassette 5. The paper feed cassette 5 has a holding portion 16 that can selectively hold at least two types of sheets P that are different in size in the paper feed direction. Sheets P held in the holding portion 16 are fed out one by one toward the first conveying path 9 by a paper feed roller 17 and a separating roller pair 18.

The stacking tray 6 can be opened and closed relative to the exterior of the apparatus main body 2. On a manual paper-feed portion 19 of the stacking tray 6, one or more sheets P are placed either one by one or together. The sheets P placed on the manual paper-feed portion 19 are fed one by one toward the second conveying path 10 by a pick-up roller 20 and a separating roller pair 21.

The first conveying path 9 and the second conveying path 10 join before (i.e., on the upstream side of) a registration roller pair 22. Upon reaching the registration roller pair 22, a sheet P is temporarily held before the registration roller pair 22, subjected to skew correction and timing adjustment, and fed toward the secondary transfer unit 23.

In the secondary transfer unit 23, a full-color toner image on an intermediate transfer belt 40 is secondary-transferred onto one side of the sheet P. After the toner image is fixed by the fixing unit 14, the sheet P is reversed on the fourth conveying path 12, as necessary, and conveyed again to the secondary transfer unit 23, where a full-color toner image is secondary-transferred onto the other side of sheet P. After the toner image secondary-transferred on the other side of the sheet P is fixed by the fixing unit 14, the sheet P with color images on both sides passes along the third conveying path 11 and is discharged by a discharge roller pair 24 to the discharge tray 3.

The image forming section 7 includes four image forming units 26, 27, 28, and 29 that form toner images of black (B), yellow (Y), cyan (C), and magenta (M), respectively. The image forming section 7 further includes an intermediate transfer-unit 30 disposed above the image forming units 26, 27, 28, and 29, and a laser scanning unit 34 disposed below the image forming units 26, 27, 28, and 29. The intermediate transfer unit 30 is configured to superimpose the toner images of the respective colors and carry the resulting toner image. The laser scanning unit 34 is configured to irradiate photosensitive drums (image bearing members) 32 (described below) with laser beams.

Each of the image forming units 26, 27, 28, and 29 includes the photosensitive drum 32 (image carrier), a charger 33 that is disposed opposite the periphery of the photosensitive drum 32, a developing unit 35 that is disposed downstream of the charger 33 in the rotation direction of the photosensitive drum 32 and opposite the periphery of the photosensitive drum 32, and a cleaner 36 that is disposed downstream of the developing unit 35 in the rotation direction of the photosensitive drum 32 and opposite the periphery of the photosensitive drum 32. The photosensitive drum 32 is irradiated at a specific position on its periphery by the laser scanning unit 34. This specific position is located between a position on the periphery of the photosensitive drum 32 opposite the charger 33 and a position on the periphery of the photosensitive drum 32 opposite the developing unit 35.

The photosensitive drum 32 in each of the image forming units 26, 27, 28, and 29 is rotated by a driving motor (not shown) counterclockwise as indicated by an arrow in the drawing. The developing unit 35 of each of the image forming units 26, 27, 28, and 29 includes a developing device 51 that stores a two-component developer containing one of the corresponding toners (black, yellow, cyan, and magenta toners).

The intermediate transfer, unit 30 includes a driving roller 38 disposed near the image forming unit 26; a driven roller 39 disposed near the image forming unit 29; a tension roller 42 disposed above the image forming unit 28; the intermediate transfer belt 40 running over the driving roller 38, the driven roller 39, and the tension roller 42; and four primary transfer rollers 41 disposed downstream of the respective developing units 35 of the image forming units 26, 27, 28, and 29 in the rotation direction of the photosensitive drums 32. The primary transfer rollers 41 are disposed such that they can be pressed into contact with the respective photosensitive drums 32 of the image forming units 26, 27, 28, and 29, with the intermediate transfer belt 40 interposed therebetween. The intermediate transfer unit 30 and the secondary transfer unit 23 constitute a transfer section 8.

In the intermediate transfer unit 30, at the positions of the primary transfer rollers 41 corresponding to the respective image forming units 26, 27, 28, and 29, the toner images of the respective colors are transferred from the corresponding photosensitive drums 32 and superimposed on one another on the intermediate transfer belt 40, and eventually formed into a full-color toner image.

The first conveying path 9 and the second conveying path 10 are provided for conveying sheets P fed from the paper feed cassette 5 and the stacking tray 6, respectively, toward the secondary transfer unit 23. The first conveying path 9 and the second conveying path 10 are provided with a plurality of conveying roller pairs 43 and the registration roller pair 22. The conveying roller pairs 43 are disposed at predetermined positions inside the apparatus main body 2. The registration roller pair 22 is disposed before the secondary transfer unit 23. The registration roller pair 22 is provided for adjusting the timing of a sheet conveying operation to an image forming operation in the image forming section 7.

The fixing unit 14 is configured to apply heat and pressure to a sheet P onto which a toner image has been transferred in the image forming section 7, thereby fixing the unfixed toner image on the sheet P. The fixing unit 14 includes, for example, a fixing roller pair composed of a pressure roller (pressure member) 44 and a fixing roller 45. The pressure roller 44 has, for example, a metal core, an elastic surface layer (e.g., of silicone rubber), and a release layer (e.g., of tetrafluoroethylene-perfluoroalkyl vinyl ether copolymer resin (PFA)). The fixing roller 45 has a metal core and an elastic surface layer (e.g., of silicone sponge). The fixing unit 14 also includes a heat roller (heating member) 46 and a heating belt (heating member) 48. The heat roller 46 is disposed adjacent to the fixing roller 45 and substantially opposite the pressure roller 44 with respect to the fixing roller 45. The heating belt 48 is looped around the heat roller 46 and the fixing roller 45. The structure of the fixing unit 14, according to some embodiments, will be described in detail later on.

In the sheet conveying direction, conveying paths 47 are provided both upstream and downstream of the fixing unit 14. A sheet P that has been conveyed through the secondary transfer unit 23 is introduced, through the conveying path 47 on the upstream side, into a fixing nip between the pressure roller 44 and the heating belt 48. The sheet P that has passed through the fixing nip between the pressure roller 44 and the heating belt 48 is conveyed through the conveying path 47 on the downstream side and guided to the third conveying path 11.

The third conveying path 11 is for conveying a sheet P that has been subjected to a fixing process in the fixing unit 14 to the discharge tray 3. For this, the third conveying path 11 is provided with a conveying roller pair 49 at an appropriate position and the discharge roller pair 24 at the exit thereof.

The fixing unit 14 included in the image forming apparatus 1, of the present illustrative embodiment will now be described in further detail. It will be understood that various values of approximate dimensions and/or parameters are provided simply by way of example for purposes of clarity, and are not intended to be limiting of the present disclosure.

Figure 2:
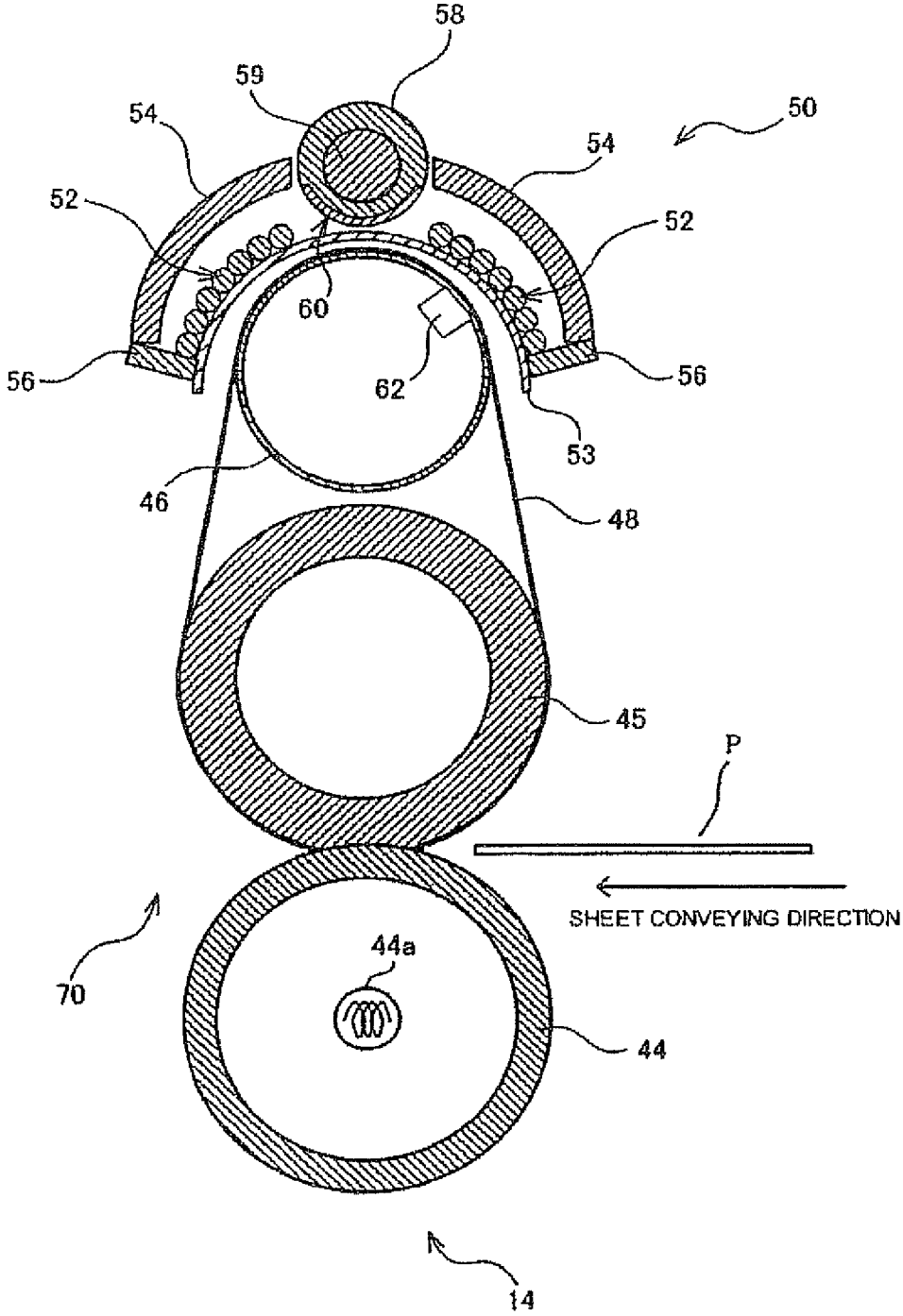
FIG. 2 is a cross-sectional view of a fixing unit, according to some embodiments.

FIG. 2 is a cross-sectional view illustrating a structure of the fixing unit 14. Note that the orientation of the fixing unit 14 illustrated in FIG. 2 is obtained by turning that of the fixing unit 14 illustrated in FIG. 1 (which illustrates a mounted state of the fixing unit 14) about 90 degrees counterclockwise. This means that the sheet conveying direction, which is upward in FIG. 1, is leftward in FIG. 2. In some implementations, the fixing unit 14 may be mounted in the orientation illustrated in FIG. 2; for example, this orientation may be well suited when the apparatus main body 2 has a larger size (e.g., when the image forming apparatus 1 is a multi-functional peripheral). Alternatively, the fixing unit 14 may be mounted in the apparatus main body 2 in a position, tilted to the left or right of that illustrated in FIG. 2.

As described above, the fixing unit 14 of the present embodiment includes the pressure roller 44, the fixing roller 45, the heat roller 46, and the heating belt 48. The pressure roller 44 is, for example, a roller having a diameter of about 50 mm, and produced by forming a silicone rubber layer of about 2 mm to about 5 mm in thickness on a metal (e.g., stainless used steel (SUS)) core and further forming a release layer (e.g., of PFA) on the surface of the silicone rubber layer. The fixing roller 45 is, for example, a roller having a diameter of about 45 mm, and produced by forming a silicone rubber sponge layer of about 5 mm to about 10 mm in thickness on a metal (e.g., SUS) core.

The heat roller 46 includes, for example, a core having a diameter of about 30 mm and formed of a magnetic metal (e.g., Fe) layer of about 0.2 mm to about 1.0 mm in thickness, and a release layer (e.g., of PFA) formed on the surface of the core. The heat roller 46 is rotated by rotation of a shaft (not shown).

The heating belt 48 includes, for example, a ferromagnetic substrate (e.g., Ni electroformed substrate) having a thickness of about 35 μm (1 μm=$1\times10^{-6}$), an elastic layer (e.g., of silicone rubber) having a thickness of about 200 μm to about 500 μm and formed on the surface of the substrate, and a release layer (e.g., of PFA) formed on the outer surface of the elastic layer. The heat-generating temperature of the heating belt 48 may be adjusted, for example, to a range of about 150° C. to about 200° C. The heating belt 48 may be a resin belt, such as a polyimide (PI) belt, if not designed to have a heat-generating function.

As described above, since the fixing roller 45 has the elastic layer of silicone rubber sponge as a surface layer, a flat fixing nip is formed between the heating belt 48 and the pressure roller 44. The pressure roller 44 has a hollow cylindrical shape. A halogen heater 44*a* is provided in the internal space of the pressure roller 44.

The fixing unit 14 further includes an IH coil unit (electromagnetic-induction heating unit) 50 (not shown in FIG. 1) outside the heat roller 46 and the heating belt 48. The IH coil unit 50 includes an induction heating coil (coil) 52, a plurality of pairs of arch cores 54, a pair of side cores 56, and a center core (core unit) 58.

The fixing unit 14 of the present embodiment can be separated into the IH coil unit 50 described above and a toner fusing unit 70. The toner fusing unit 70 of the present embodiment has a box-shaped housing (not shown) which contains the pressure roller 44, the fixing roller 45, and the heating belt 48.

The toner fusing unit 70 can be removed from the apparatus main body 2 in the direction connecting the rotation center of the fixing roller 45 to that of the pressure roller 44. That is, the toner fusing unit 70 can be removed from the apparatus main body 2 leftward in FIG. 1 (i.e., downward in FIG. 2).

In the example of FIG. 2, for induction heating in an arc-shaped portion (in cross-sectional view) of the heat roller 46 and the heating belt 48 facing the IH coil unit 50, the induction heating coil 52 is disposed on a virtual arc-shaped surface (in cross-sectional view) that extends along the arc-shaped outer surface of the heat roller 46. A coil bobbin (coil holder) 53 is disposed outside the heat roller 46 and the heating belt 48. The induction heating coil 52 is in the form of a winding on the coil bobbin 53. The coil bobbin 53 may, for example, be made of heat-resistant resin (e.g., polyphenylenesulfide resin (PPS), polyethylene terephthalate resin (PET), or liquid crystal polymer resin (LCP)). The induction heating coil 52 may be secured to the coil bobbin 53, for example, with a heat-resistant, adhesive (e.g., a silicone adhesive).

Figure 3:
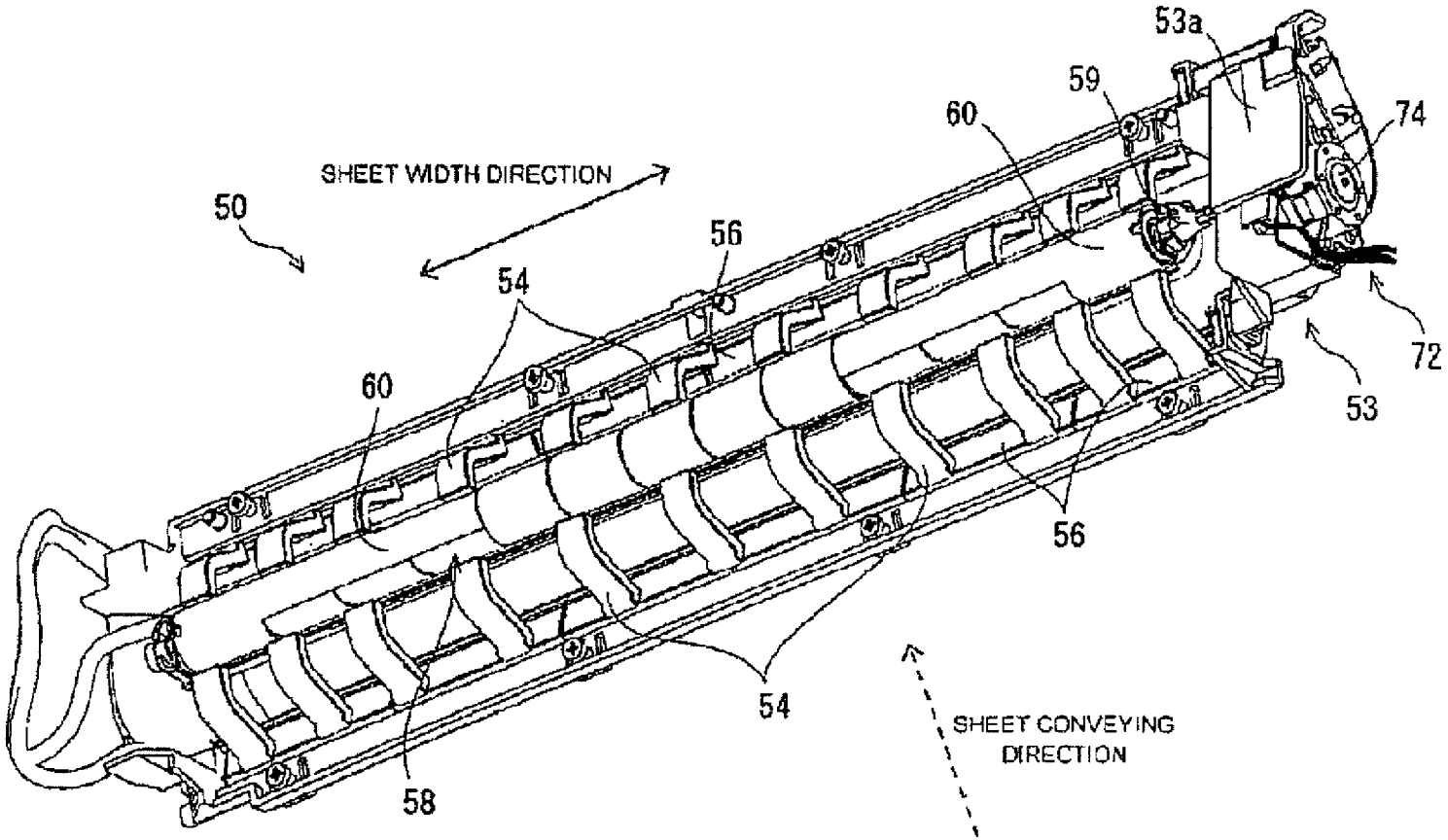
FIG. 3 is a perspective view of an IH coil unit illustrated in FIG. 2.

The coil bobbin 53 is molded to follow the outer surface of the heat roller 46 and the heating belt 48. FIG. 3 is a perspective view of the IH coil unit 50 illustrated in FIG. 2. As illustrated in FIG. 3, the coil bobbin 53 of the present embodiment is provided with a casing 53*a* at one end. A gear train 79 (described below) of drive unit 72 is disposed in the casing 53*a*. That is, the drive unit 72 of the present embodiment is assembled to and is integral with the coil bobbin 53.

As illustrated in FIG. 2, the center core 58 is disposed in the center of the IH coil unit 50, and the arch cores 54 and the side cores 56 are arranged in pairs on both sides of the center core 58. The arch cores 54 on both sides are ferrite cores molded in an arched shape in cross section. The arch cores 54 are symmetric with respect to the center core 58. The overall length of each arch core 54 is greater than the corresponding length of the region where the induction heating coil 52 is present. The side cores 56 on both sides are ferrite cores molded in a block shape. The side cores 56 on both sides are joined to one end (lower end in FIG. 2) of each arch core 54. The side cores 56 cover the outside of the region where the induction heating coil 52 is present.

The arch cores 54 are spaced, for example, in the longitudinal direction of the IH coil unit 50 (see FIG. 3). In the present embodiment, a distance between adjacent arch cores 54 is about 10 mm. In general, the higher the arrangement density of the arch cores 54, the better the performance of magnetic flux induction. However, the performance of magnetic flux induction is not significantly degraded even if the arrangement density of the arch cores 54 is reduced to some extent. Therefore, the arrangements density of the arch cores 54 may be set such that sufficient performance can be achieved cost-effectively. The temperature distribution of the heating belt 48 in the axial direction can be adjusted by adjusting the arrangement density of the arch cores 54. In the present embodiment, for example, the arrangement density of the arch cores 54 is set such that the region occupied by the arch cores 54 is about ½ to about ⅓ of the entire region where the arch cores 54 can be arranged. When the arrangement density of the arch cores 54 at both ends in the longitudinal direction of the heating belt 48 is set to be higher than that in the center region, it is possible to prevent a decrease in temperature in end regions of the heating belt 48 in the longitudinal direction.

The side cores 56 are divided into a plurality of pieces, each having a length of about 30 mm to, about 60 mm in the sheet width direction. The plurality of pieces of the side cores 56 are arranged continuously without space in the longitudinal direction of the heat roller 46. The overall length of the region where the side cores 56 are arranged corresponds to the length of the region where the induction heating coil 52 is present. With this arrangement, where the plurality of pieces of the side cores 56 are arranged continuously without space, it is possible to even out variations in temperature distribution associated with the arrangement of the arch cores 54. The arrangements of the arch cores 54 and the side cores 56 are determined, for example, in accordance with the distribution, of magnetic fluxes (magnetic field strengths) from the induction heating coil 52. Since the arch cores 54 are arranged at certain intervals, the side cores 56 reinforce the magnetic focusing effect in places where the arch cores 54 are not present. It is thus possible to even out the magnetic flux distribution (and hence temperature distribution) in the longitudinal direction of the heating belt 48.

In the example of FIG. 2, the heat roller 46 is internally provided with a thermistor 62. The thermistor 62 inside the heat roller 46 is located at a position corresponding to an area where the amount of heat generated by induction heating is particularly large. Alternatively or additionally, a non-contact temperature sensor may be provided below the IH coil unit 50 so that the outer surface temperature of the heating belt 48 can be detected.

The center core 58 illustrated in FIG. 2 and FIG. 3 is, for example, a ferrite core that is a circle in cross section (e.g., about 18 mm in outside diameter). The center core 58 has a shaft 59 that extends axially in the center of the center core 58. The shaft 59 is made of, for example, non-magnetic metal (e.g., SUS) or heat-resistant resin (e.g., PPS, PET, or LCP). The center core 58 has substantially the same length as that of the heat roller 46. Specifically, the center core 58 has a length that can accommodate a maximum sheet passing width of, for example, 13 inches (about 340 mm). The center core 58 is positionally secured to the shaft 59.

In the illustrative embodiment, the center core 58 is provided with a shielding member 60 that extends along the outer surface of the center core 58. The shielding member 60 may be a thin plate that is curved overall in aware shape in cross section. The shielding member 60 may be embedded in a thick portion of the center core 58 as illustrated in FIG. 2, or may be attached to the outer surface of the center core 58, with, for example, a heat-resistant adhesive (e.g., a silicone adhesive).

In some implementations it may be preferable that the shielding member 60 be made of non-magnetic material with good electrical conductivity. For example, oxygen-free copper may be used as a material of the shielding member 60. An induction current is generated in the shielding member 60 when a magnetic flux substantially perpendicular to the surface of the shielding member 60 passes through the shielding member 60. The induction current causes an inverse magnetic flux to be generated in the shielding member 60. The inverse magnetic flux has a direction opposite the magnetic flux that has passed through the shielding member 60. By cancelling the interlinkage magnetic flux (passed-through magnetic flux perpendicular to the shielding member 60) with the inverse magnetic flux, a magnetic flux from the induction heating coil 52 can be blocked or suppressed. When the shielding member 60 is made of material with good electrical conductivity, it is possible to suppress generation of Joule heat in the shielding member 60 caused by an induction current, and thus to efficiently block or suppress a magnetic flux from the induction heating coil 52. Examples of ways to improve electrical conductivity of the shielding member 60 are (1) to select a material with as small a specific resistance as possible, and (2) to increase the thickness of the shielding member 60. Specifically, in some implementations it may be preferable for the thickness of the shielding member 60 to be 0.5 mm or more. In the present embodiment, for example, the shielding member 60 having a thickness of 1 mm is used.

When, as illustrated in FIG. 2, the shielding member 60 is located at a position (shielding position) close to the surface of the heating belt 48, the magnetic resistance increases and the magnetic, field strength decreases in the vicinity of the induction heating coil 52. On the other hand, if the center core 58 illustrated in FIG. 2 rotates 180 degrees (in either direction) to bring the shielding member 60 to a position (retracted position) farthest from the heating belt 48, the magnetic resistance decreases in the vicinity of the induction heating coil 52. This creates magnetic paths extending from the center core 58 through the arch cores 54 and the side cores 56 on both sides of the center core 58, and causes the magnetic flux to act on the heating belt 48 and the heat roller 46.

Figure 4:
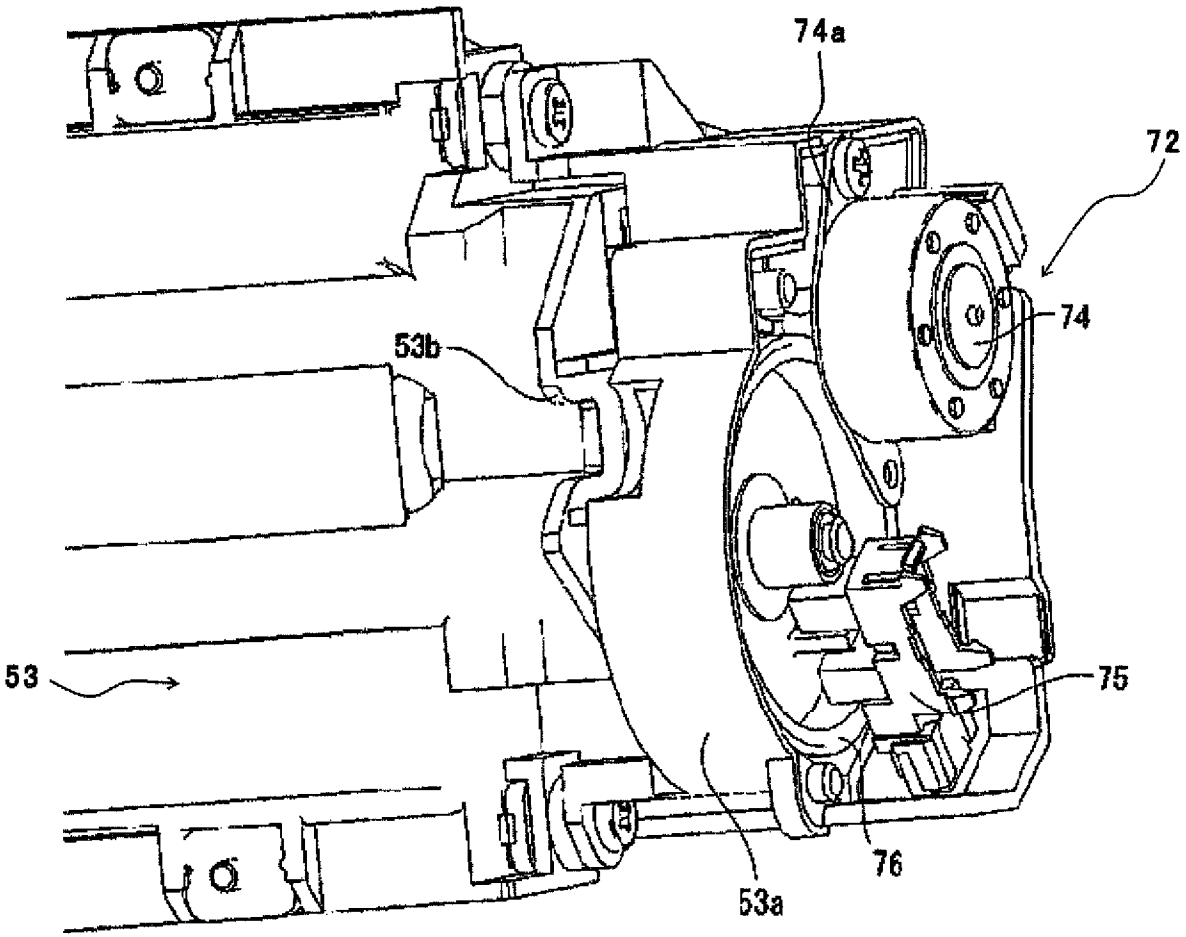
FIG. 4 is an enlarged view of a casing and parts therearound at an end of the IH coil unit illustrated in FIG. 3.
Figure 5:
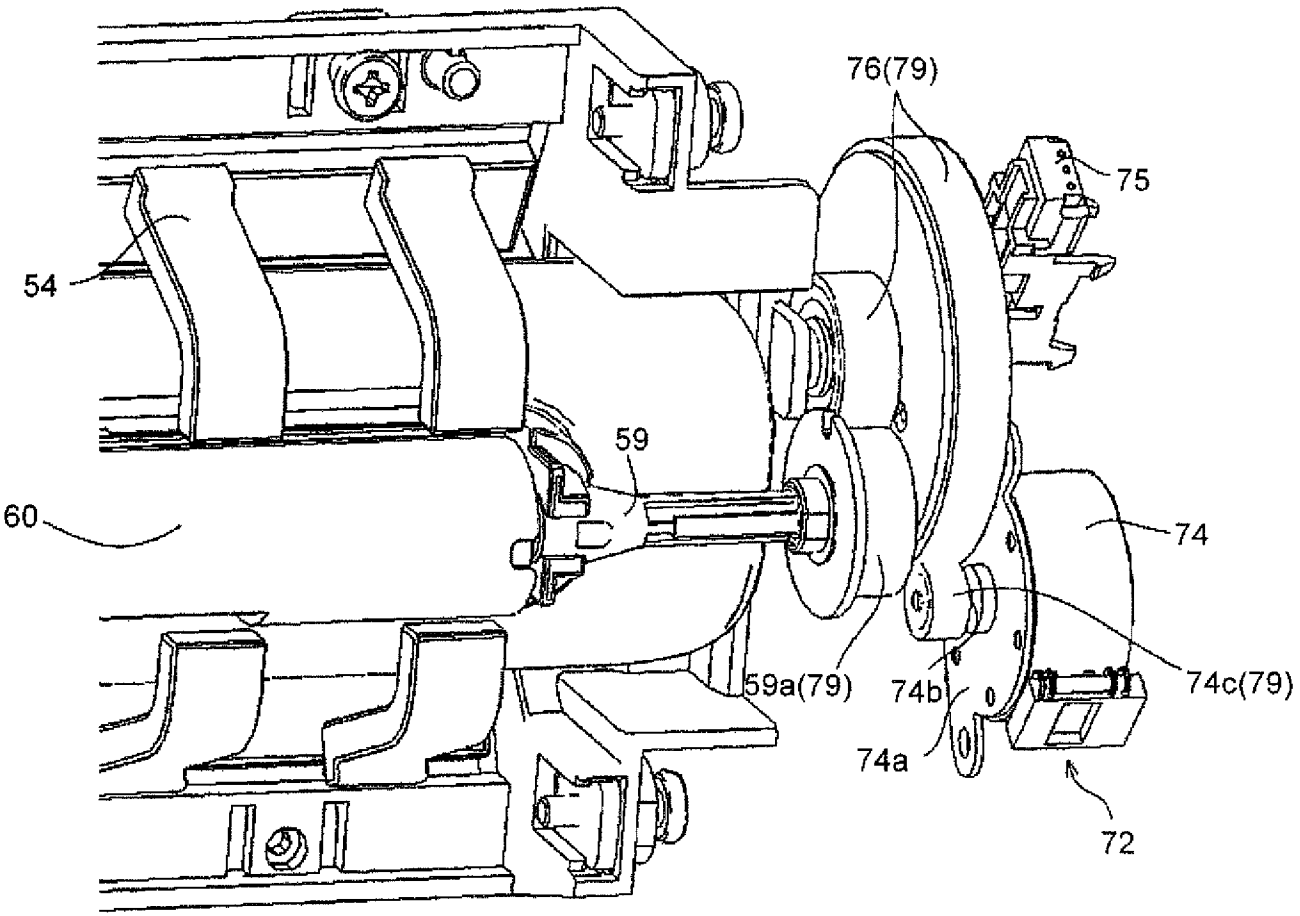
FIG. 5 is an enlarged view of a drive unit and parts therearound at the end of the IH coil unite illustrated in FIG. 3.

The drive unit 72 described above is, for example, equipped with a stepping motor 74 (see FIG. 3 to FIG. 5). The shaft 59 of the center core 58 is rotated by power from the stepping motor 74. FIG. 4 is an enlarged view of the casing 53*a* and parts therearound at an end of the IH coil unit 50 illustrated in FIG. 3. FIG. 5 is an enlarged view of the drive unit 72 and parts therearound at the end of the IH coil unit 50 illustrated in FIG. 3. The casing 53*a* is omitted in FIG. 5 for easy viewing of the structure of the drive unit 72. A driven gear 59*a* is attached to an end of the shaft 59 (see FIG. 5). A speed reduction gear train 76 composed of large and small gears engages with the driven gear 59*a*.

The casing 53*a* serves as a frame for both the driven gear 59*a* and the speed reduction gear train 76. The stepping motor 74 is secured to a motor substrate 74*a* that covers an end portion of the casing 53*a*.

When the stepping motor 74 is driven, the power of the stepping motor 74 is transmitted to the shaft 59 through a motor gear 74*c* secured to a shaft 74*b* of the stepping motor 74, large and small-diameter gears of the speed reduction gear train 76, and the driven gear 59*a*. The power thus can rotate the center core 58 about the longitudinal axis thereof. The motor gear 74*c*, the reduction gear train 76, and the driven gear 59*a* are collectively referred to as the gear train 79.

To detect a rotation angle of the center core 58 (i.e., a rotational displacement of the center core 58 from a reference position), a sensor 75 detects the amount of rotation of the shaft 59 (see FIG. 4 and FIG. 5). The detection signal from the sensor 75 is input through an input driver (not shown) to a control integrated circuit (IC) (not shown). On the basis of the detection signal, the control IC can detect the rotation angle of the center core 58 from the reference position. On the other hand, the control IC receives information about the current sheet size from an image formation controller (not shown). Upon receipt of information, the control IC reads information about a rotation angle (i.e., an angle from the reference position) appropriate for the sheet size from a semiconductor memory (read-only memory (ROM)) (not shown). The control IC outputs, at predetermined intervals, driving pulses to achieve the read rotation angle (target rotation angle). The driving pulses are applied through an output driver (not shown) to the stepping motor 74, which then operates in accordance with the driving pulses.

Figure 6:
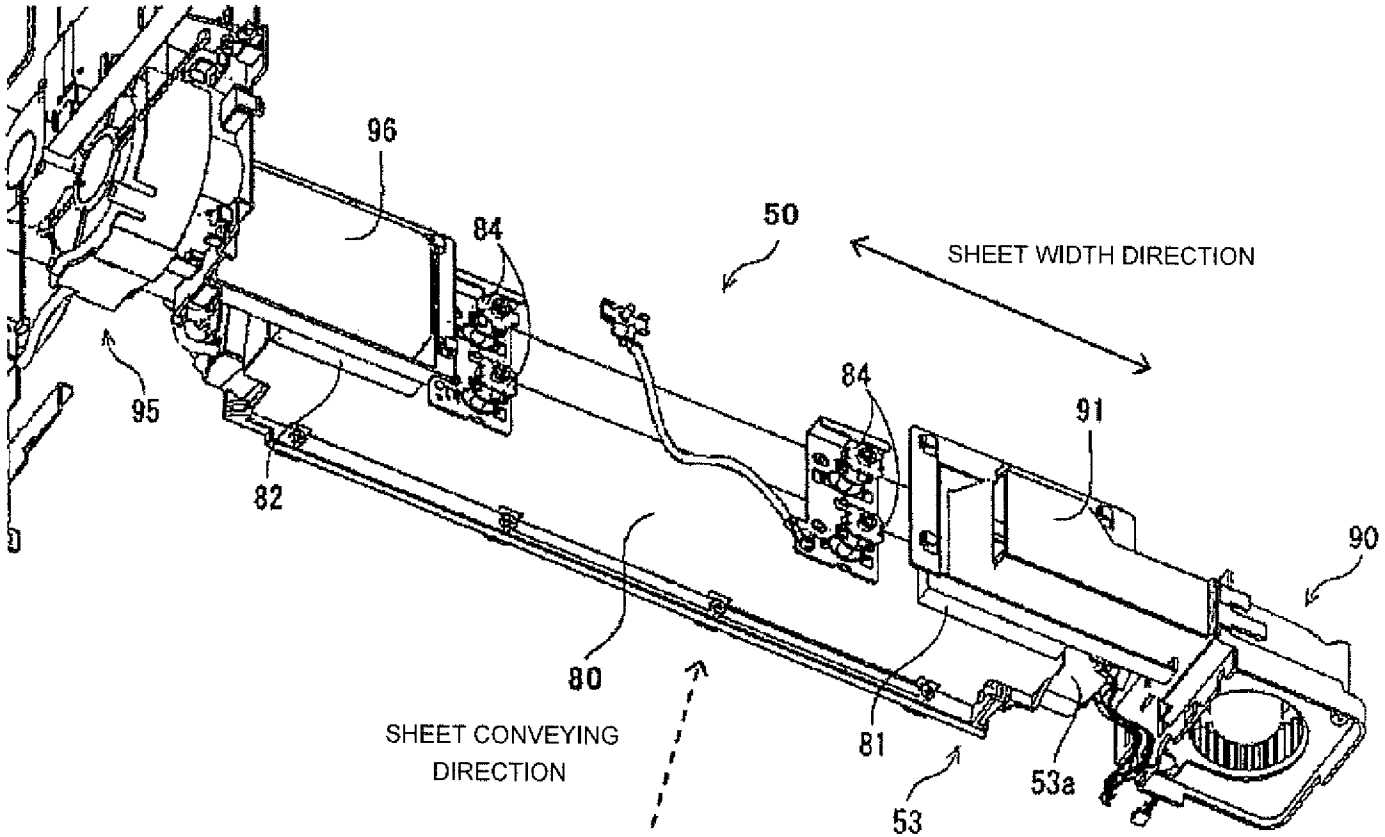
FIG. 6 is an external perspective view of the IH coil unit.
Figure 7:
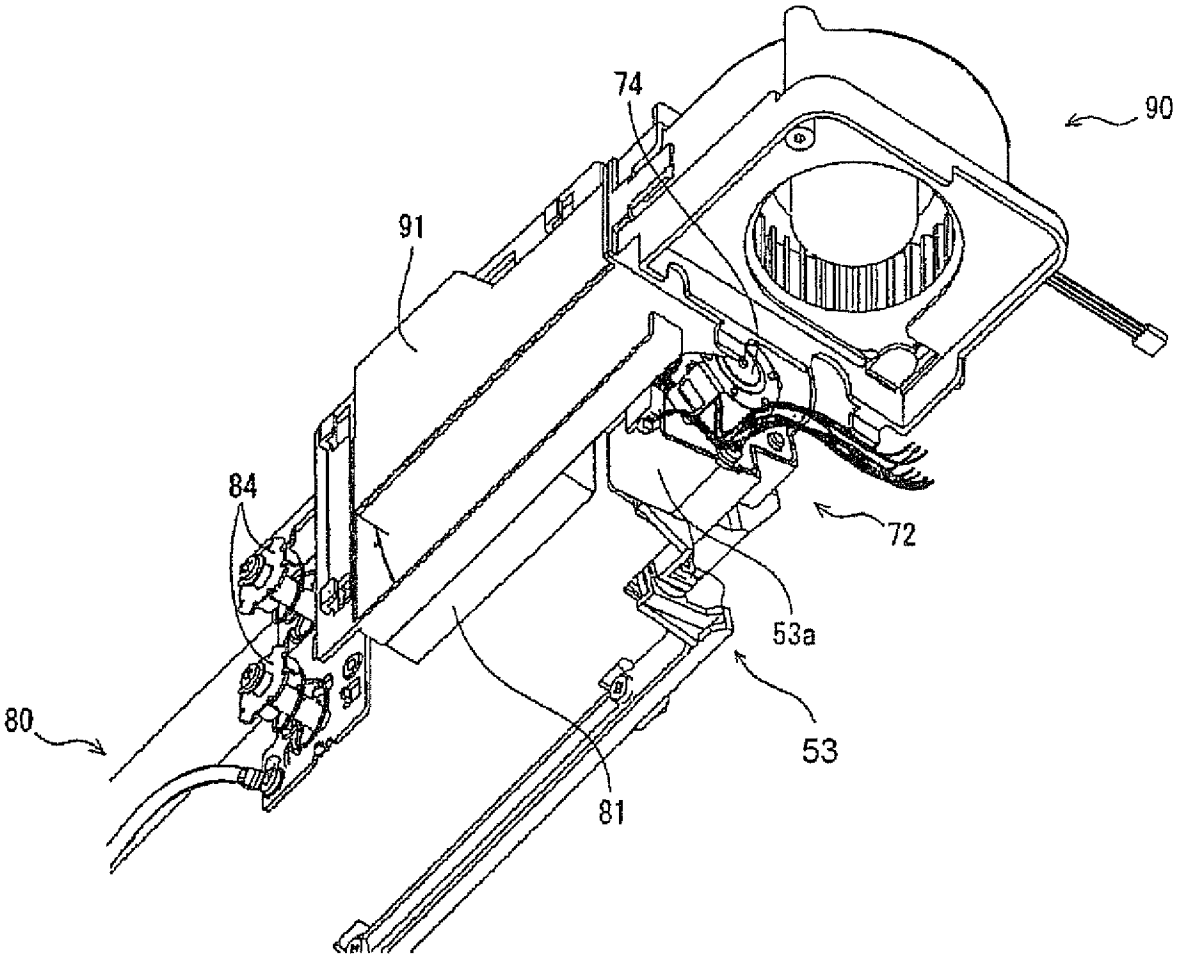
FIG. 7 is an enlarged view of the casing and parts therearound illustrated in FIG. 6.
Figure 8:
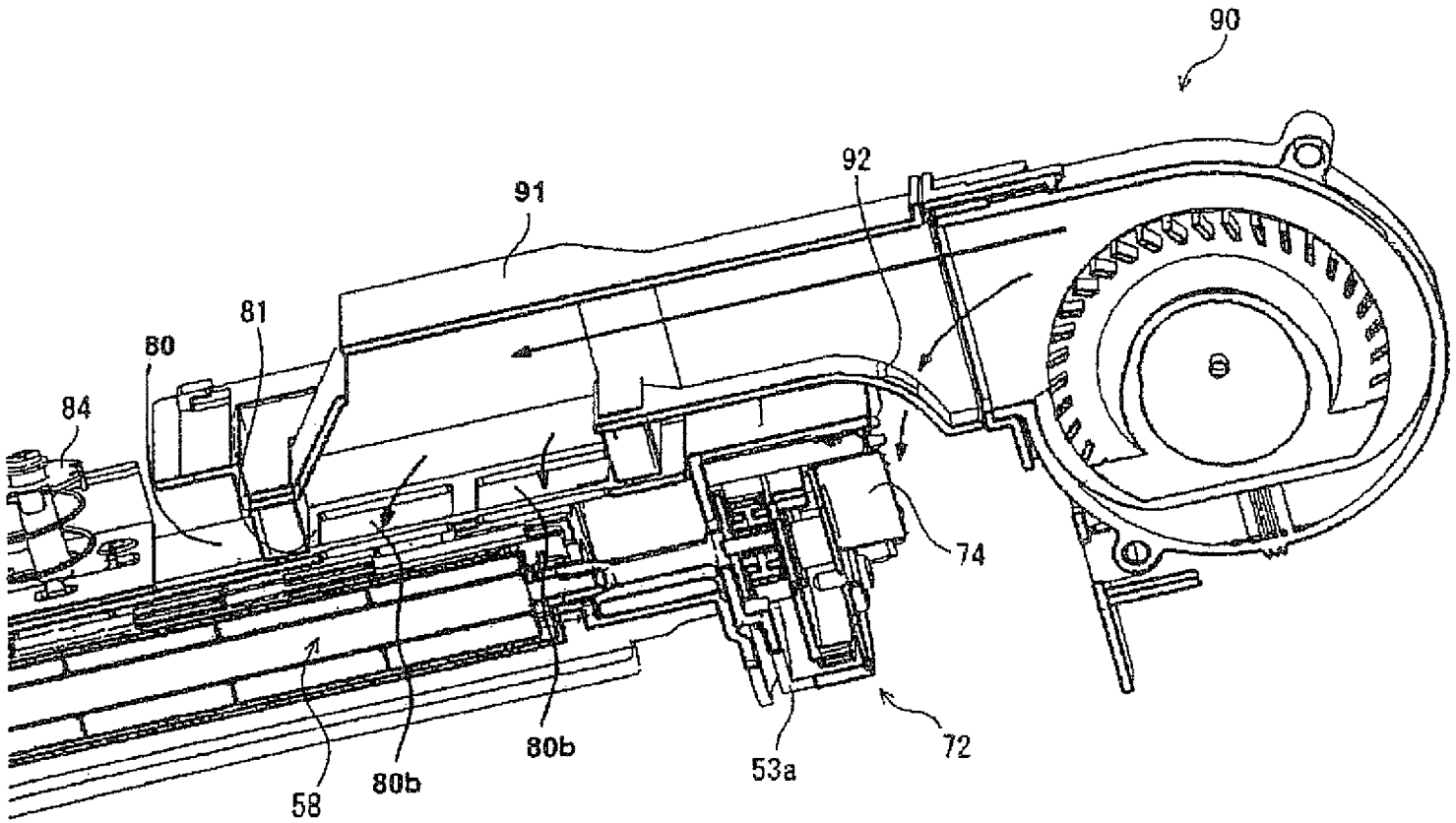
FIG. 8 illustrates a flow of air in the casing illustrated in FIG. 6.

A shield cover 80 is omitted in FIG. 3 to FIG. 5 for easy viewing of the structure of the arch cores 54, etc. As illustrated in FIG. 6, which is an external perspective view of the IH coil unit 50, the shield cover 80 made of metal (e.g., aluminum) is disposed outside the arch cores 54 and the side cores 56 illustrated in FIG. 2. The arch cores 54 and the side cores 56 are supported on the coil bobbin 53 by the shield cover 80. FIG. 7 is an enlarged view of the casing 53*a* and parts therearound illustrated in FIG. 6. FIG. 8 illustrates a flow of air in the casing 53*a* illustrated in FIG. 6.

As illustrated in FIG. 6, the shield cover 80 of the present embodiment is provided with two pairs of support shafts 84, with each pair protruding at respective positions displaced from each other along the sheet width direction. The shield cover 80 is also provided with upstream and downstream ducts (duct members) 81 and 82 in a region outside the support shafts 84 as viewed in the axial direction (that is, sheet width direction illustrated in FIG. 6) of the center core 58.

Specifically, the upstream duct 81 is disposed above the casing 53*a* in FIG. 6. The upstream duct 81 connects an intake fan (cooling unit) 90 (described below) to openings 80*b* (see FIG. 8) provided in the shield cover 80 and located above a folded portion of the induction heating coil 52. The downstream duct 82 is disposed in the shield cover 80 opposite the upstream duct 81. The downstream duct 82 connects an exhaust fan 95 (described below) to openings (not shown) provided in the shield cover 80 and located above a folded portion of the induction heating coil 52 opposite the above-mentioned folded portion. The ducts 81 and/or 82 may, for example, be formed as members that are integral with the shield cover 80, or may be formed as separate members that are attachable to the shield cover 80.

Figure 9:
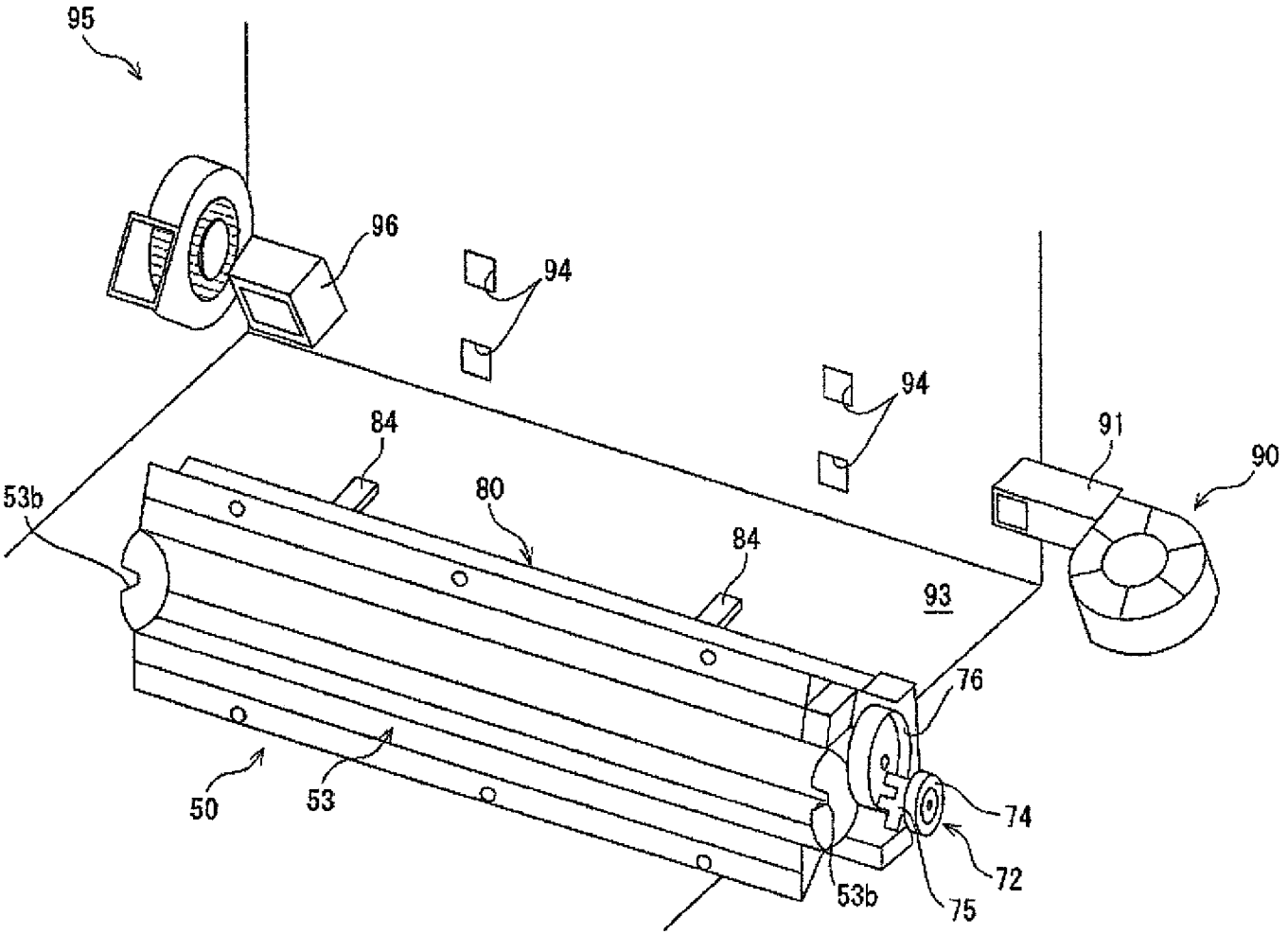
FIG. 9 is a perspective view illustrating a relationship between the IH coil unit and a unit mounting part.
Figure 10:
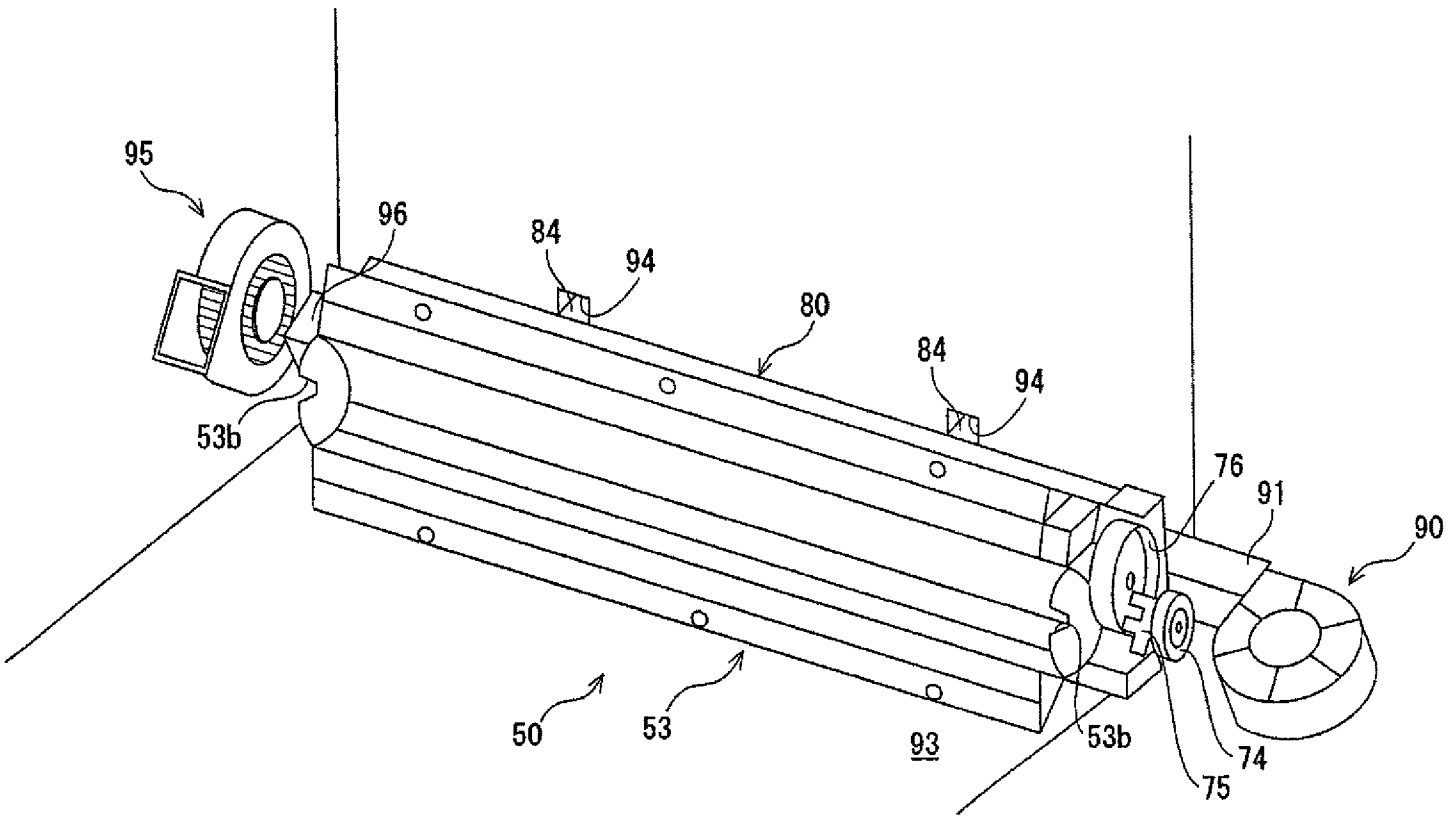
FIG. 10 is another perspective view illustrating a relationship between the IH coil unit and the unit mounting part.

FIG. 9 and FIG. 10 are perspective views each illustrating a relationship between the IH coil unit 50 and the unit mounting part 93. FIG. 9 illustrates a state before the IH coil unit 50 is mounted on the apparatus main body 2 (or the unit mounting part 93). FIG. 10 illustrates a state after the IH coil unit 50 is mounted on the apparatus main body 2. The intake fan 90 and the exhaust fan 95 described above are disposed to the right and left, respectively, of the unit mounting part 93 illustrated in FIG. 9 and FIG. 10. The casing 53*a* is omitted in FIG. 9 and FIG. 10 for easy viewing of the structure of the drive unit 72.

More specifically, as illustrated in FIG. 9 where the IH coil unit 50 is detached from the unit mounting part 93, the intake fan 90 is disposed to the right of the unit mounting part 93 and the exhaust fan 95 is disposed to the left of the unit mounting part 93. A duct 91 at an end of the intake fan 90 can be connected through a cushioning member (not shown) to the upstream duct 81 of the shield cover 80 (see. FIG. 6). Similarly, a duct 96 at an end of the exhaust fan 95 can be connected through a cushioning member (not shown) to the downstream duct 82 of the shield cover 80 (see FIG. 6).

When the IH coil unit 50 is mounted on the unit mounting part 93 such that the support shafts 84 of the shield cover 80 are inserted into respective receiving holes 94 of the unit mounting part 93 (see FIG. 10), the intake fan 90 and the exhaust fan 95 communicate (i.e., for providing air flow therebetween) with the upstream duct 81 and the downstream duct 82 of the shield cover 80, respectively, while the stepping motor 74 and the sensor 75 of the drive unit 72 are disposed between the intake fan 90 and the coil bobbin 53.

In the present embodiment, the duct 91 is provided with an opening 92 near the drive unit 72 (see FIG. 8). Thus, as indicated by an arrow in FIG. 8, cooling air from the intake fan 90 is guided to flow outward through the opening 92 and is directly supplied to the drive unit 72. At the same time, the cooling air from the intake fan 90 is guided through the duct 91 and the upstream duct 81, introduced into the inside of the shield cover 80, and supplied to the induction heating coil 52. After flowing inside the shield cover 80 in the longitudinal direction and cooling the induction heating coil 52, the air current passes through the downstream duct 82 and the duct 96 to reach the exhaust fan 95, and is discharged to the outside.

In the embodiment described above, the cooling air from the intake fan 90 is supplied to the drive unit 72 through the opening 92 of the duct 91. Alternatively, the cooling air may be supplied to the drive unit 72 after being introduced into the inside of the shield cover 80.

In some, embodiments, a duct for an air path leading only to the drive unit 72 may be branched off from the duct 91 so that cooling air from the intake fan 90 can be directly supplied toward the drive unit 72.

As illustrated in FIG. 9 and FIG. 10, the coil bobbin 53 has positioning portions 53*b* at respective ends thereof. The positioning portions 53*b* rotatably, support a rotation shaft (not shown) of the heat roller 46. When both ends of the rotation shaft of the heat roller 46 are engaged with the respective positioning portions 53*b*, the axis of the center core 58 and the axis of the heat roller 46 are parallel to each other, while the distance between the center core 58 and the surface of the heat roller 46 and the distance between the surface of the heating belt 48 looped around the heat roller 46 and the center core 58 are maintained constant. When the toner fusing unit 70 is removed from the apparatus main body 2, the IH coil unit 50 including the drive unit 72 is left behind on the unit mounting part 93 of the apparatus main body 2 (see FIG. 9).

As described above, in the present embodiment, the fixing unit 14 uses a method in which a toner image is heated and fused by applying induction heating (external IH) to the heat roller 46 etc. The fixing unit 14 includes the IH coil unit 50 having the induction heating coil 52, the coil bobbin 53, and the center core 58, and the toner fusing unit 70 having the heat roller 46, the heating belt 48, and the pressure roller 44.

A stepping motor (not shown) is connected to the pressure roller 44. By power from the stepping motor, the pressure roller 44 is rotated about an axis extending across the width of a conveyed sheet P. The rotation of the pressure roller 44 causes the heating belt 48 to run, so that a fixing nip is formed between the heating belt 48 and the pressure roller 44.

In the IH coil unit 50, electromagnetic induction heating is performed in which a magnetic flux generated in the induction heating coil 52 causes the heat roller 46, etc., to generate eddy currents. The center core 58 can adjust the heating width of the heat roller 46, etc., under rotational control of the drive unit 72.

The toner fusing unit 70 can be attached to and removed from the IH coil unit 50. At the point when the toner fusing unit 70 is attached to the IH coil unit 50 that is already mounted on the apparatus main body 2, the position of the toner fusing unit 70 relative to that of the IH coil unit 50 is determined and thus, the axis of the heat roller 46 etc. becomes parallel to that of center core 58.

According to various embodiments, such as the present embodiment, the drive unit 72 that transmits rotation to the center-core 58 is included as an integral part in the IH coil unit 50, and is directly connected to the center core 58. Therefore, because the drive unit 72 is disposed in the IH coil unit 50, when the IH coil unit 50 is disposed such that the IH coil unit 50 can swing relative to the apparatus main body 2, there is no possibility that a connecting component of the IH coil unit 50 hits that of the drive unit 72 when the toner fusing unit 70 is attached to the IH coil unit 50. Since the connecting components can thus be prevented from being damaged, even when the IH coil unit 50 and the toner fusing unit 70 are configured such that they can be separated from each other, it is possible to improve the reliability of the IH coil unit 50 while ensuring the heat-generating capability of the heat roller 46, etc.

Additionally, since in accordance with some embodiments, such as the present embodiment, the drive unit 72 that transmits rotation to the center core 58 is integral with the coil bobbin 53, the drive unit 72 cart be mounted with its existing configuration. Moreover, since a frame for the speed reduction gear train 76 of the drive unit 72 can be formed in the casing 53*a* of the coil bobbin 53, a simple configuration of the drive unit 72 can be achieved. This contributes to reduced manufacturing cost and size of the fixing unit 14.

Also, in accordance with some embodiments, the drive unit 72 is exposed to cooling air and thus can be prevented from overheating or being exposed to a high-temperature environment that may have deleterious effects. Therefore, it is possible to maintain the performance of the stepping motor 74 and the sensor 75, which are components of the drive unit 72, and to further improve the reliability of the IH coil unit 50.

Moreover, since the heat-generating capability of the heat roller 46 is ensured and good fixed images can be produced, the reliability of the image forming apparatus 1 can be improved.

In view of the illustrative embodiments described above, it is understood that a fixing device according to some embodiments of the present disclosure uses a method in which a toner image is heated and fused by applying induction heating (external IH) to the heating member. The fixing device includes the electromagnetic-induction heating unit having the coil and the core unit, and the toner fusing unit having the heating member and the pressure member. In the electromagnetic-induction heating unit, the coil generates a magnetic flux for performing electromagnetic-induction heating by causing the heating member to generate eddy currents, while the core unit can adjust the heating width in the toner fusing unit under rotational control of the drive unit.

The toner fusing unit can be attached to and removed from the electromagnetic-induction heating unit. At the point when the toner fusing unit is attached to the electromagnetic-induction heating unit that is already mounted on the apparatus main body, the position of the toner fusing unit relative to the electromagnetic-induction heating unit is determined.

According to the present disclosure, the drive unit that transmits rotation to the core unit is included as an integral part in the electromagnetic-induction heating unit. That is, since the drive unit is integral with the core unit, there is no possibility that the connecting component of the electromagnetic-induction heating unit hits that of the drive unit. Since the connecting components can thus be prevented from being damaged, even when the electromagnetic-induction heating unit and the toner fusing unit are configured such that the electromagnetic-induction heating unit and the toner fusing unit can be separated from each other, it is possible to improve the reliability of the electromagnetic-induction heating unit while ensuring the heat-generating capability of the heating member.

The present disclosure is not limited to the embodiments described above, and can be implemented in various modified forms. For example, although the image forming apparatus is embodied as a printer in the embodiments described above, it is to be understood that the image forming apparatus of the present disclosure is applicable to multi-functional peripherals, copiers, and facsimiles.

In any of these cases, it is possible to improve the reliability of an IH coil unit that is configured to be separated from (e.g., is removably attachable to) a toner fusing unit.

Having thus described in detail embodiments of the present disclosure, it is to be understood that the disclosure of the foregoing paragraphs is not to be limited to particular details and/or embodiments set forth in the above description, as many apparent variations thereof are possible without departing from the spirit or scope of the present disclosure.

What is claimed is:

1. A fixing device for fixing a toner image on a recording medium, the fixing device comprising:

a toner fusing unit that is operable to fix the toner image on the recording medium and that includes a pressure member and a heating member in contact with the pressure member to form a fixing nip therebetween;

an electromagnetic-induction heating unit having (i) a coil disposed along an outer surface of the heating member and configured to generate a magnetic flux for applying induction heating to the heating member, (ii) core unit disposed opposite the heating member with the coil interposed therebetween to provide for a magnetic path around the coil, the core unit being configured to rotate about an axis extending across the width of the recording medium, and (iii) a coil holder for holding the coil and having a casing; and a drive unit-attached to the coil holder of the electromagnetic-induction heating unit, configured to rotate the core unit, and including a gear train disposed inside the casing.

2. The fixing device according to claim 1, wherein the toner fusing unit is configured to be attachable to and removable from the electromagnetic-induction heating unit.

3. The fixing device according to claim 1, wherein the coil holder has a positioning portion for positioning the heating member.

4. The fixing device according to claim 1, further comprising a cooling unit, wherein the coil is cooled by cooling air from the cooling unit, and the drive unit is disposed between the cooling unit and the coil holder.

5. The fixing device according to claim 4, wherein the drive unit is cooled by cooling air from the cooling unit.

6. The fixing device according to claim 4, further comprising:

a shield cover; and a duct member;

wherein the cooling unit and the shield cover are connected to each other through the duct member.

7. The fixing device according to claim 6, wherein the duct member has an opening; and the drive unit is cooled by cooling air blown from the cooling unit through the duct member and the opening.

8. An image forming apparatus comprising:

an image forming section configured to form a toner image;

a transfer section configured to transfer the toner image formed by the image forming section to a recording medium; and a fixing device configured to fix the toner image transferred by the transfer section to the recording medium on the recording medium, wherein the fixing device includes a toner fusing unit that is operable to fix the toner image on the recording medium and that includes a pressure member and a heating member in contact with the pressure member to form a fixing nip therebetween;

an electromagnetic-induction heating unit having (i) a coil disposed along an outer surface of the heating member and configured to generate a magnetic flux for applying induction heating to the heating member, (ii) core unit disposed opposite the heating member with the coil interposed therebetween to provide for a magnetic path around the coil, the core unit being configured to rotate about an axis extending across the width of the recording medium, and (iii) a coil holder for holding the coil and having a casing; and a drive unit attached to the coil holder of the electromagnetic-induction heating unit, configured to rotate the core unit, and including a gear train disposed inside the casing.

9. The image forming apparatus according to claim 8, wherein the toner fusing unit is configured to be attachable to and removable from the electromagnetic-induction heating unit.

10. The image forming apparatus according to claim 8, wherein the coil holder has a positioning portion for positioning the heating member.

11. The image forming apparatus according to claim 8, further comprising a cooling unit, wherein the coil is cooled by cooling air from the cooling unit, and the drive unit is disposed between the cooling unit and the coil holder.

12. The image forming apparatus according to claim 11, wherein the drive unit is cooled by cooling air from the cooling unit.

13. The image forming apparatus according to claim 11, further comprising:

a shield cover; and a duct member, wherein the cooling unit and the shield cover are connected to each other through the duct member.

14. The image forming apparatus according to claim 13, wherein the duct member has an opening; and the drive unit is cooled by cooling air blown from the cooling unit through the duct member and the opening.

15. An electromagnetic-induction heating unit for use in a fixing device for fixing a toner image on a recording medium, the electromagnetic induction heating unit comprising:

a coil configured to generate a magnetic flux for applying induction heating;

a core unit disposed to provide for a portion of a magnetic path around the coil, and being configured to rotate about an axis extending along the width of the recording medium when the electromagnetic-induction heating unit is installed for use;

a coil holder for holding the coil and having a casing; and a drive unit attached to the coil holder of the electromagnetic-induction heating unit, configured to rotate the core unit, and including a gear train disposed inside the casing.

* * * * *